US011279127B2

(12) United States Patent
Uchida

(10) Patent No.: US 11,279,127 B2
(45) Date of Patent: Mar. 22, 2022

(54) ELECTRIC APPARATUS AND CONTROL METHOD THEREFOR

(71) Applicant: CANON KABUSHIKI KAISHA, Tokyo (JP)

(72) Inventor: Eriko Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/024,291

(22) Filed: Sep. 17, 2020

(65) Prior Publication Data

US 2021/0078321 A1 Mar. 18, 2021

(30) Foreign Application Priority Data

Sep. 18, 2019 (JP) ..... JP2019-169579

(51) Int. Cl.
*B41J 2/045* (2006.01)
*B41J 25/00* (2006.01)

(52) U.S. Cl.
CPC ..... *B41J 2/04573* (2013.01); *B41J 2/04586* (2013.01); *B41J 25/006* (2013.01)

(58) Field of Classification Search
CPC .. B41J 2/04571; B41J 2/04573; B41J 2/0458; B41J 2/04581; B41J 2/04586; B41J 25/006
See application file for complete search history.

(56) References Cited

U.S. PATENT DOCUMENTS 10,913,273 B2 * 2/2021 Orihara ..... B41J 2/04571
2019/0335055 A1 10/2019 Suzuki et al.

FOREIGN PATENT DOCUMENTS

JP 2011-102012 A 5/2011

* cited by examiner

*Primary Examiner* — Thinh H Nguyen
(74) *Attorney, Agent, or Firm* — Venable LLP

(57) ABSTRACT

An electric apparatus for controlling movement of an object detects the movement of the object, and estimates a control quantity for performing first feedback control for the object in a first period, based on a detection signal. The apparatus further generates, based on the detection signal, a timing signal for estimating a state quantity of the object in order to perform second feedback control for the object in a second period shorter than the first period, estimates the state quantity based on the timing signal, generates a first operation quantity for the first feedback control based on the control quantity, generates a second operation quantity for the second feedback control based on the state quantity, and generates an operation quantity of the object from the first operation quantity and the second operation quantity.

20 Claims, 10 Drawing Sheets

ELECTRIC APPARATUS AND CONTROL METHOD THEREFOR

BACKGROUND OF THE INVENTION

Field of the Invention

The present invention relates to an electric apparatus and a control method therefor, and particularly to, for example, a technique of controlling driving of a moving object such as the carriage of a serial type printing apparatus.

Description of the Related Art

As for driving of a carriage that reciprocally moves by a motor in a serial type printer, feedback control such as PID control using an encoder is common practice. In a serial type inkjet printer, a driving unit that scans a carriage mounted with a printhead for discharging ink emphasizes a velocity vibration at the time of scanning the carriage to stabilize an ink landing position. Thus, it is required to implement control for stabilizing a velocity vibration of the carriage.

In a printing apparatus and a gain correction method described in Japanese Patent Laid-Open No. 2011-102012, a constant (gain) for PID control is corrected in accordance with a correction ratio based on a velocity vibration quantity for a predetermined period during which a specific control target is operated. According to Japanese Patent Laid-Open No. 2011-102012, as the velocity vibration quantity is larger, the correction ratio for PID control can be made smaller. As a result, an excessive vibration is suppressed, thereby making it possible to implement convergence of the velocity vibration of the control target.

In the printing apparatus and the gain correction method described in Japanese Patent Laid-Open No. 2011-102012, to converge the velocity vibration of the control target, the control gain of the control target is decreased resultantly. Therefore, although it is possible to suppress an excessive vibration of a control target, the responsiveness of the control target is spoiled. That is, compatibility between traceability and vibration suppression in a change in state of the control target becomes an issue.

SUMMARY OF THE INVENTION

Accordingly, the present invention is conceived as a response to the above-described disadvantages of the conventional art.

For example, an electric apparatus and a control method therefor according to this invention are capable of achieving compatibility between traceability of feedback control and vibration suppression of a control target.

According to one aspect of the present invention, there is provided an electric apparatus for controlling movement of an object, comprising: a detection unit configured to detect the movement of the object; a first estimation unit configured to estimate, based on a detection signal output from the detection unit, a control quantity for performing first feedback control for the object at a first period; a timing signal generation unit configured to generate, based on the detection signal output from the detection unit, a timing signal for estimating a state quantity of the object in order to perform second feedback control for the object at a second period shorter than the first period; a second estimation unit configured to estimate the state quantity based on the timing signal generated by the timing signal generation unit; a first generation unit configured to generate, based on the control quantity estimated by the first estimation unit, a first operation quantity for the first feedback control; a second generation unit configured to generate, based on the state quantity estimated by the second estimation unit, a second operation quantity for the second feedback control; and a synthesizing unit configured to generate an operation quantity of the object from the first operation quantity and the second operation quantity.

According to another aspect of the present invention, there is provided a control method for an electric apparatus for controlling movement of an object, comprising: detecting the movement of the object; estimating, based on a detection signal output in the detecting, a control quantity for performing first feedback control for the object at a first period; generating, based on the detection signal output in the detecting, a timing signal for estimating a state quantity of the object in order to perform second feedback control for the object at a second period shorter than the first period; estimating the state quantity based on the generated timing signal; generating, based on the estimated control quantity, a first operation quantity for the first feedback control; generating, based on the estimated state quantity, a second operation quantity for the second feedback control; and generating an operation quantity of the object from the first operation quantity and the second operation quantity.

The invention is particularly advantageous since it is possible to achieve compatibility between traceability of feedback control and vibration suppression of a control target.

Further features of the present invention will become apparent from the following description of exemplary embodiments (with reference to the attached drawings).

DESCRIPTION OF THE EMBODIMENTS

Figure 1A:
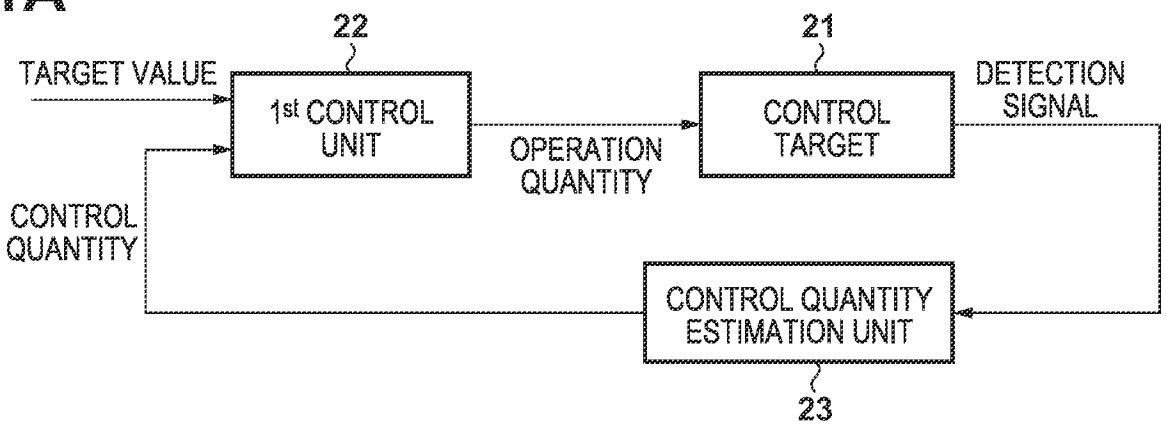
FIGS. 1A and 1B are block diagrams each showing a feedback control arrangement in a driving control unit of a carriage motor of a printing apparatus.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In the following description, control of driving of a motor that moves a carriage of a serial type printing apparatus as an exemplary example of an electric apparatus will be exemplified. However, the present invention is not limited to the carriage of the printing apparatus, and motor control according to the present invention is applicable to any unit that moves an object by driving a motor. For example, in the printing apparatus, motor control is applicable to control of driving of a conveyance motor used to convey a print medium such as a print sheet. The present invention also includes a scanner apparatus that optically reads an image of an original while moving a CCD line scanner or CIS by driving a motor.

1. Explanation of Feedback Control

Figure 1B:
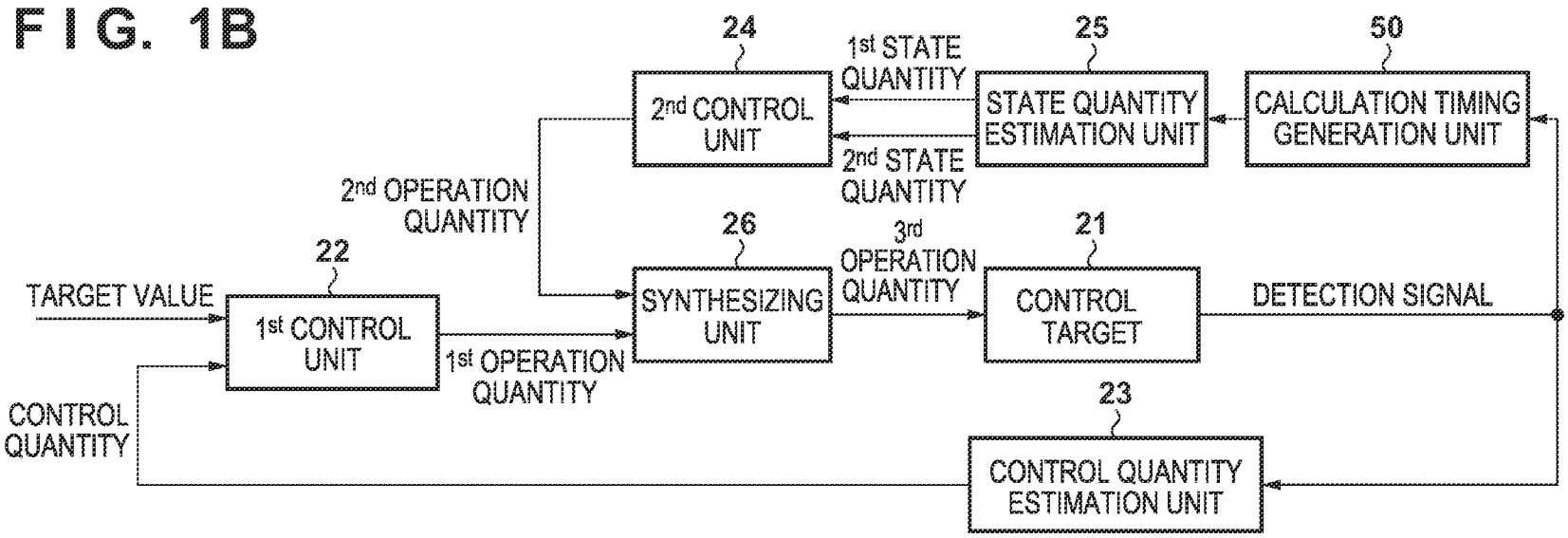

FIGS. 1A and 1B are block diagrams each showing a feedback control arrangement in a driving control unit of a carriage motor of a printing apparatus. FIG. 1A is a block diagram showing a general control arrangement. FIG. 1B is a block diagram showing a control arrangement used in this embodiment.

First, the general feedback control arrangement will be described with reference to FIG. 1A.

As shown in FIG. 1A, a detection signal (the position and velocity of a carriage) that detects the state of a control target (for example, a carriage) 21 is output to a control quantity estimation unit (for example, a CPU) 23 to estimate the control quantity of position/velocity information or the like. The control quantity is output to a first control unit (for example, a carriage driver) 22 to calculate an operation quantity for converging the control target 21 to a target value which is input. When the operation quantity is output to the control target 21, a feedback control loop is formed.

To stably operate the control target, it is necessary to set various parameters while ensuring an allowance in terms of control in consideration of the characteristic of the control target. If the allowance is insufficient, a vibration occurs, and an oscillation phenomenon may lead to an uncontrollable state. On the other hand, if the allowance is too large, the traceability performance of the control target deteriorates but it is unavoidable to impose a restriction on the traceability performance for vibration suppression.

Next, the feedback control arrangement used in this embodiment will be described with reference to FIG. 1B.

As shown in FIG. 1B, in feedback control, in addition to the feedback control loop shown in FIG. 1A, another feedback control loop using the detection signal from the control target 21 is formed. That is, the detection signal that detects the state of the control target 21 is output to the control quantity estimation unit 23 to estimate the control quantity of the position/velocity information of the carriage or the like. The control quantity is output to the first control unit 22, and the first control unit 22 calculates the first operation quantity for converging the control target 21 to the target value. Then, the first control unit 22 outputs the first operation quantity to the control target 21 via a synthesizing unit 26, thereby forming the first feedback loop.

On the other hand, the detection signal that detects the state of the control target 21 is also input to a calculation timing generation unit 50 for generating a calculation timing to calculate the second operation quantity. Here, the calculation timing according to the state of the control target 21 is generated, and a state quantity estimation unit 25 estimates the first and second state quantities in accordance with the calculation timing.

The second state quantity is obtained by the time differentiation of the first state quantity. More specifically, the first and second state quantities are values formed from a combination of a position and a velocity or a combination of a velocity and an acceleration. These values are output to a second control unit 24. The second control unit 24 calculates the second operation quantity. Next, the second control unit 24 outputs the second operation quantity, and the synthesizing unit 26 synthesizes the first and second operation quantities, and outputs a synthesizing result to the control target 21. The second feedback loop "control target 21→calculation timing generation unit 50→state quantity estimation unit 25→second control unit 24→synthesizing unit 26→control target 21" is thus formed.

Since the first and second state quantities have the relationship between, for example, the position (x) and velocity (v) of the carriage or between the velocity (v) and acceleration (a) of the carriage, the relationship between the two state quantities (two variables) can be represented by a two-dimensional space.

Figure 2:
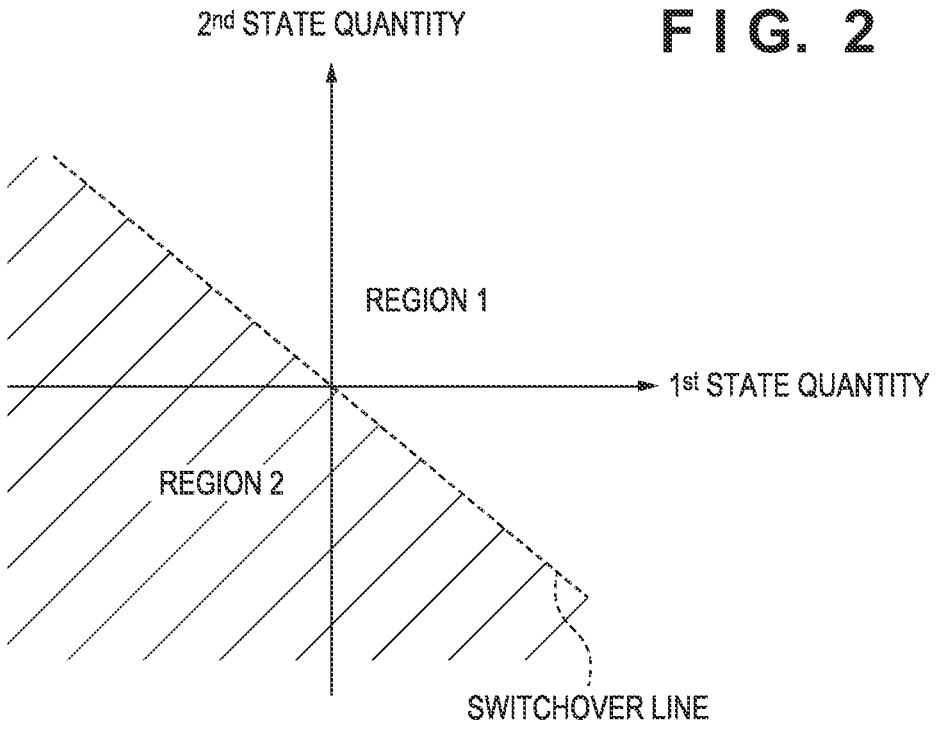
FIG. 2 is a view showing a two-dimensional coordinate space representing the relationship between the first and the second state quantities.

FIG. 2 is a view showing a two-dimensional coordinate space representing the relationship between the first and second state quantities. Referring to FIG. 2, the abscissa defines the first state quantity and the ordinate defines the second state quantity.

As shown in FIG. 2, two divided regions are defined in advance on the plane, and the plane is divided into two regions by a function called a switchover line. These divided regions will be referred to as regions 1 and 2 hereinafter. The function representing the switchover line is a linear function represented by a relationship "$S2=k\times S1$" where S1 represents the first state quantity and S2 represents the second state quantity. Note that k represents a switchover coefficient.

As shown in FIG. 2, with respect to the switchover line, an upper region (white) is region 1 and a lower region (hatched) is region 2. If there is the relationship between the first and second state quantities in region 1, a positive operation quantity is output. If there is the relationship between the first and second state quantities in region 2, a negative operation quantity is output. Note that in accordance with an operation condition, a negative sign may be assigned to region 1 and a positive sign may be assigned to region 2. When the sign is switched over every time the two regions are crossed, the operation quantity implements movement corresponding to a switching operation. The second control unit 24 outputs such operation quantity as the second operation quantity to the control target 21 via the synthesizing unit 26.

The first and second operation quantities are updated asynchronously. The synthesizing unit 26 adds the quantities while adjusting the update timings, and outputs an added value as the third operation quantity to the control target 21.

Next, an example in which the feedback control shown in FIG. 1B is applied to control of the velocity of the carriage that reciprocates while being mounted with a printhead in the serial type printing apparatus will be described.

2. Explanation of Application Example of Feedback Control

A serial type printing apparatus to which control of forming the two feedback loops explained with reference to FIG. 1B is applied will be described.

<Explanation of Printing Apparatus (FIGS. 3 and 4)>

Figure 3:
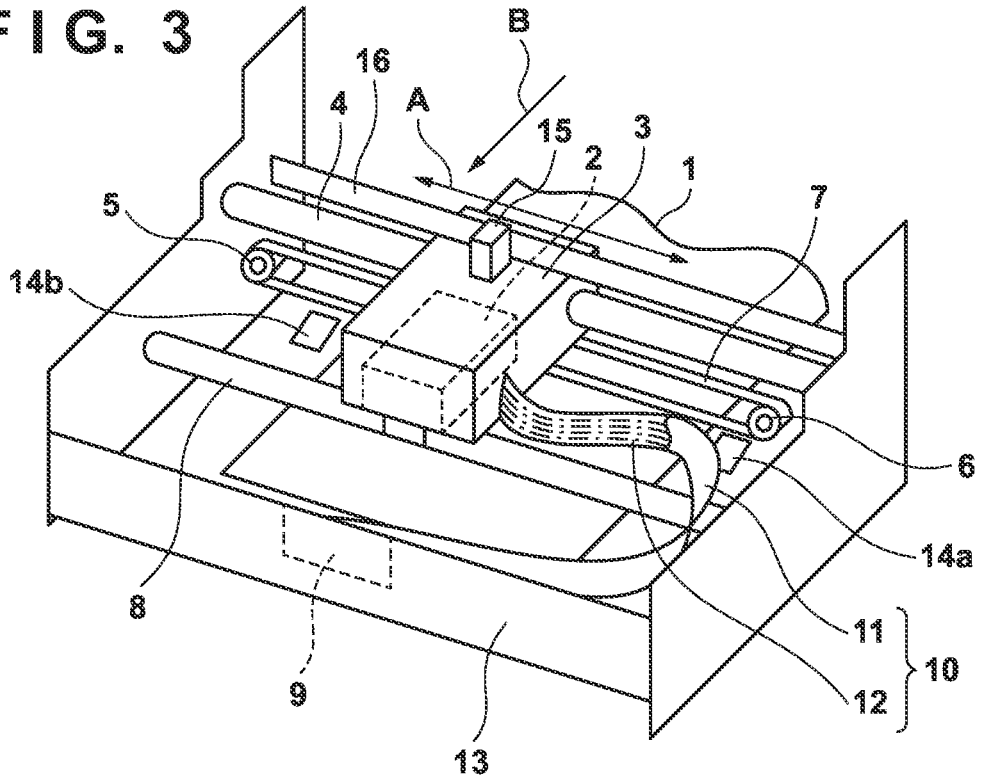
FIG. 3 is a perspective view showing the main mechanism part of an inkjet printing apparatus according to an exemplary embodiment of the present invention.

FIG. 3 is an external perspective view showing the arrangement of the printing apparatus mounted with an inkjet printhead (to be referred to as a printhead hereinafter) that discharges ink droplets in accordance with an inkjet method according to the exemplary embodiment of the present invention.

A carriage (moving object) 3 mounted with a printhead 2 is supported slidably by a guide shaft 4, and reciprocally moves above a print medium (sheet) 1. A carriage motor (DC motor) 5 with a pulley is arranged at one end of the moving range of the carriage 3, an idle pulley 6 is arranged at the other end, and a timing belt 7 is looped between the carriage motor 5 and the idle pulley 6, thereby connecting the carriage 3 to the timing belt 7.

To prevent the carriage 3 from rotating about the guide shaft 4, a support member 8 installed to extend in parallel to the guide shaft 4 is installed, and the carriage 3 is also supported slidably by the support member 8. In the printhead 2, a number of print elements are provided and an FFC (Flexible Flat Cable) 11 for supplying the driving signals of the print elements from the main body portion of the printing apparatus to the printhead 2 is arranged. The FFC 11 has a long thin film shape, a conductive pattern for transmitting a driving signal is formed in the inside or surface of the FFC 11, and the FFC 11 has flexibility so that it bends along with the movement of the carriage 3 to move the central position of bending.

Furthermore, an ink tank (not shown) is arranged outside the carriage 3, and a tube 12 that supplies, to the printhead 2, ink contained in the ink tank is provided. The tube 12 has flexibility so that it bends along with the movement of the carriage 3 to move the central position of bending. A connecting member 10 formed from the FFC 11 and the tube 12 is connected between the carriage 3 and a fixing portion 9 of the main body of the printing apparatus.

Furthermore, a linear scale 16 that is used to acquire the position information of the carriage 3 is arranged in parallel to the moving direction (main scanning direction) of the carriage, and is configured to be read by an encoder sensor 15 attached to the carriage 3. Ink collection ports 14*a* and 14*b* for collecting ink preliminarily discharged by the printhead 2 are provided on both the outsides in the width direction of the print medium 1. The preliminary discharge indicates an operation for discharging, at positions irrelevant to printing, ink adhered to the distal end portions of nozzles immediately before the start of printing or during execution of printing.

With this arrangement, the carriage 3 reciprocally moves in a direction (main scanning direction) of an arrow A. The print medium 1 is conveyed by a conveyance motor (not shown) in a direction (sub-scanning direction) of an arrow B vertically intersecting the moving direction of the carriage 3.

Figure 4:
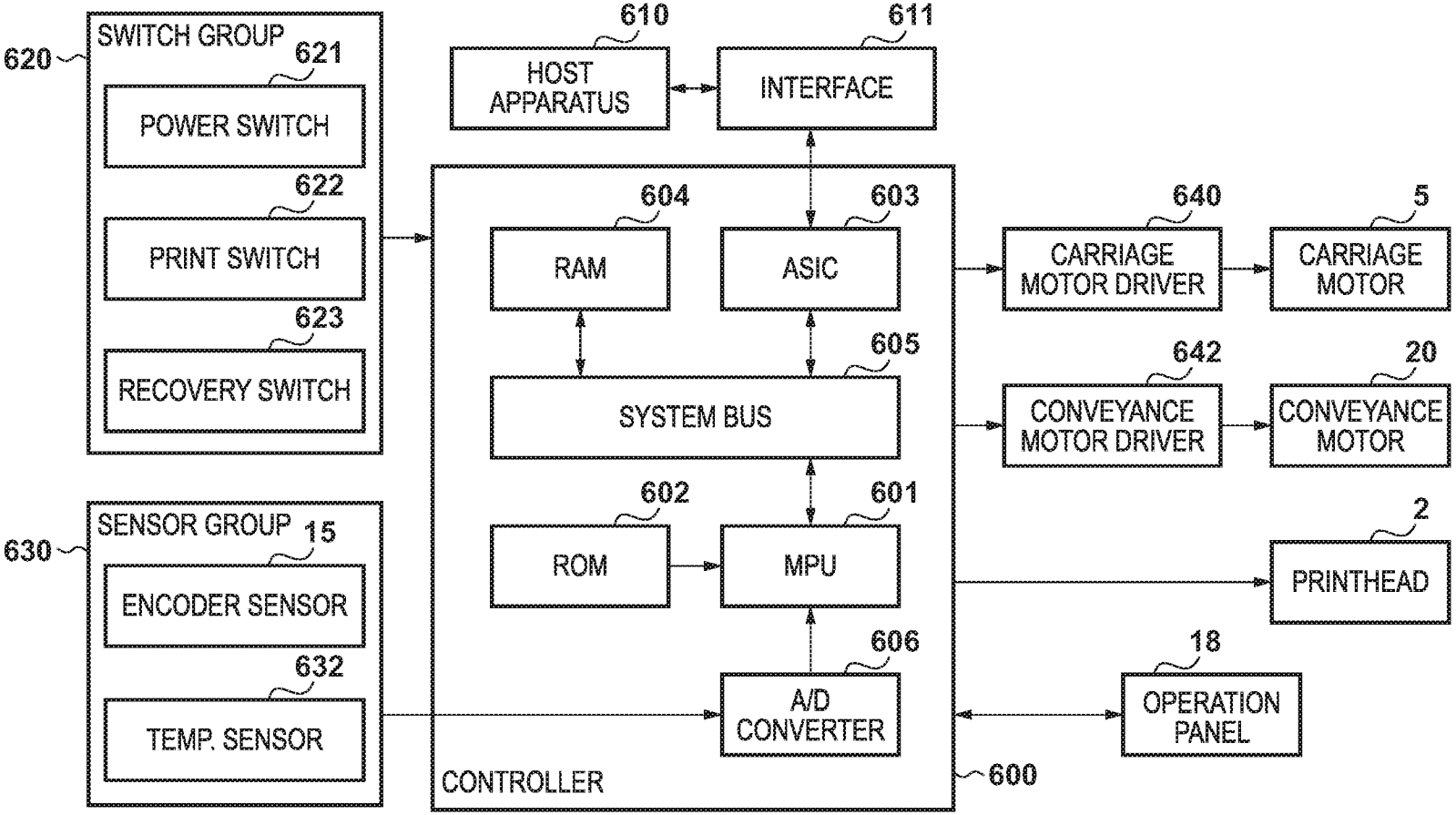
FIG. 4 is a block diagram showing a control unit of the printing apparatus shown in FIG. 3.

FIG. 4 is a block diagram showing the control arrangement of the printing apparatus shown in FIG. 3.

As shown in FIG. 4, a controller 600 is formed by an MPU 601, a ROM 602, an ASIC (Application Specific Integrated Circuit) 603, a RAM 604, a system bus 605, an A/D converter 606, and the like. The ROM 602 stores a program corresponding to a control sequence (to be described later), a required table, and other fixed data.

The ASIC 603 generates control signals for controlling the carriage motor 5, a conveyance motor 20, and the printhead 2. The RAM 604 is used as a loading area of image data, a work area for executing a program, and the like. The system bus 605 interconnects the MPU 601, the ASIC 603, and the RAM 604 to exchange data. The A/D converter 606 receives an analog signal from a sensor group (to be described below), performs A/D conversion, and supplies a digital signal to the MPU 601.

Referring to FIG. 4, a host apparatus 610 serves as an image data supply source. Image data, a command, a status, and the like are transmitted/received between the host apparatus 610 and the printing apparatus 1 via an interface (I/F) 611 using, for example, a protocol based on the USB standard.

Furthermore, a switch group 620 is formed from a power switch 621, a print switch 622 used to issue a print start instruction or the like, a recovery switch 623, and the like.

A sensor group 630 is formed from the encoder sensor 15, a temperature sensor 632, and the like which are used for detecting an apparatus status.

A carriage motor driver 640 drives the carriage motor 5 for causing the carriage 3 to reciprocally scan in the direction of the arrow A, and a conveyance motor driver 642 drives the conveyance motor 20 for conveying a print medium P.

At the time of print scanning by the printhead, the ASIC 603 transfers data for driving the print elements (heaters for discharge) to the printhead while directly accessing the memory area of the RAM 604. In addition, this printing apparatus includes, as a user interface, an operation panel 18 formed by an LCD or LED. From the viewpoint of apparatus implementation, the switch group 620 may be included in the operation panel 18.

The ASIC 603 operates as a calculation processing unit to perform image processing and actuator control, and executes calculation processing by receiving a command from the MPU 601. Feedback control calculation is partially executed by the ASIC 603, and details thereof will be described later. The MPU 601 is responsible for part of calculation for feedback control of the carriage 3, and executes driving calculation of the carriage motor 5 in accordance with a print sequence. When the host apparatus 610 issues a print command via the interface 611, the carriage 3 reciprocally moves for a print operation.

3. Details of Feedback Control Arrangement for Carriage Control of Printing Apparatus Application of the feedback control arrangement described with reference to FIG. 1B to carriage driving control in the printing apparatus described with reference to FIGS. 3 and 4 will be described in detail.

Figure 5:
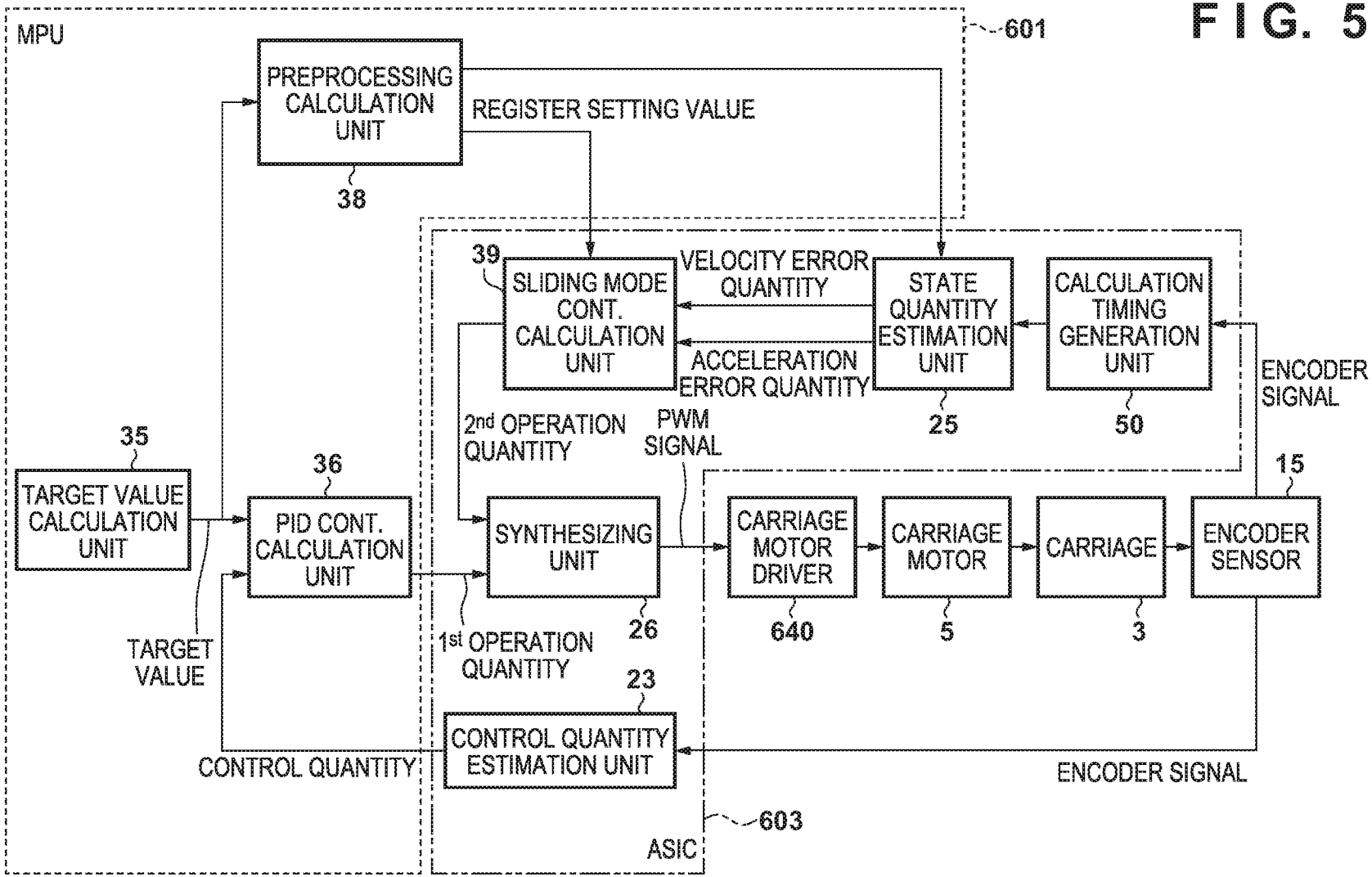
FIG. 5 is a block diagram for explaining details of carriage driving control in the printing apparatus shown in FIGS. 3 and 4.

FIG. 5 is a block diagram for explaining details of carriage driving control in the printing apparatus shown in FIGS. 3 and 4.

Accuracy for causing ink to land at a correct position is required for carriage control of the printing apparatus in order to ensure the print quality by the printhead 2. An ink droplet discharge timing from the printhead 2 is calculated from the moving velocity (v) of the carriage 3, and it is important to minimize a velocity vibration. To achieve this, a vibration target to be suppressed in the feedback control according to this embodiment is the velocity of the carriage. Therefore, the first and second state quantities in the feedback control described with reference to FIG. 1B are formed from a combination of the velocity and acceleration of the carriage 3, and are input to the second control unit 24.

Furthermore, the control target in the feedback control is the carriage 3, and the encoder sensor 15 outputs encoder signals to the control quantity estimation unit 23 and the state quantity estimation unit 25. In general, two A- and B-phase pulse signals whose phases are different from each other by 90° are used as encoder signals. In this embodiment as well, two A- and B-phase pulse signals are used as the encoder signals.

Figure 6:
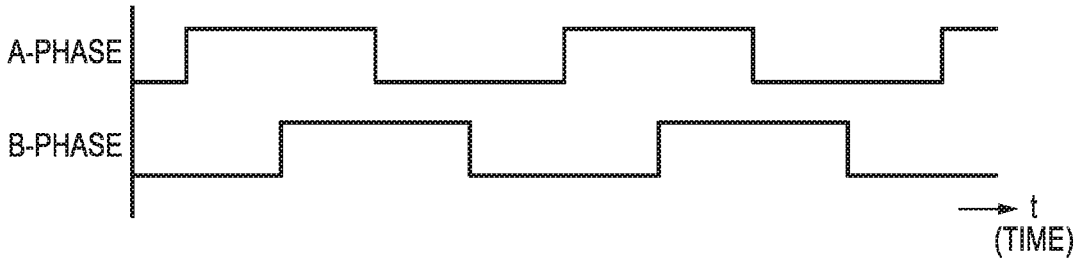
FIG. 6 is a view showing A- and B-phase encoder signals.

FIG. 6 is a timing chart showing the A- and B-phase encoder signals.

The control quantity estimation unit 23 estimates position information by counting the pulse signal, and estimates velocity information by measuring the pulse width of the pulse signal. This position/velocity information or the like is output as a control quantity to a PID control calculation unit 36 corresponding to the first control unit 22.

A target value calculation unit 35 generates a target profile for moving the carriage 3 to a target position in accordance with a desired acceleration condition and velocity condition, and outputs the target profile as a target value. The PID control calculation unit 36 performs PID control calculation using the target value from the target value calculation unit 35 and the control quantity from the control quantity estimation unit 23, and outputs a calculation result as the first operation quantity.

The encoder signal from the encoder sensor 15 is also output to the calculation timing generation unit 50, and a timing signal generated by the calculation timing generation unit 50 is output to the state quantity estimation unit 25. The state quantity estimation unit 25 includes a velocity/acceleration information generation unit, and velocity/acceleration information according to the calculation timing is generated. The state quantity estimation unit 25 also receives a register setting value output from a preprocessing calculation unit 38. The register setting value is a value obtained by replacing, by the preprocessing calculation unit 38, the target value from the target value calculation unit 35 by a value in a unit system used in the state quantity estimation unit. The state quantity estimation unit 25 estimates velocity information and acceleration information from the encoder signal, and calculates an error quantity with respect to the register setting value as an operation target. A velocity error quantity and acceleration error quantity as the error quantity are output, as a combination of state quantities in the velocity dimension and acceleration dimension, to a sliding mode control calculation unit 39 corresponding to the second control unit 24.

The sliding mode control calculation unit 39 forms a two-dimensional plane space formed from two variables of the velocity error quantity and the acceleration error quantity. Region determination of the two-dimensional plane described with reference to FIG. 2 is obtained by:

phase switchover line ($S$)=switchover coefficient× acceleration error quantity+velocity error quantity For example, if S>0, the current state quantity is located in region 1 as the upper portion with respect to the switchover line. On the other hand, if S<0, the current state quantity is located in region 2 as the lower portion with respect to the switchover line. If S=0, S=0 is defined as S>0 or S<0. The sign of the operation quantity is decided based on the region determination result, and the operation quantity is output as the second operation quantity. Note that the switchover coefficient is updated by the register setting value output from the preprocessing calculation unit 38. As a special case, the phase switchover line may not use both the acceleration error quantity and the velocity error quantity but use only one of them.

The update timings of the first and second operation quantities will now be described.

The first operation quantity is updated every time control calculation by the PID control calculation unit 36 is executed. The carriage motor driving control unit (carriage motor driver) of the printing apparatus to which the feedback control shown in FIG. 1B is applied often executes control calculation at a period of about 1 kHz. On the other hand, the second operation quantity is updated every time control calculation by the sliding mode control calculation unit 39 is executed. A change in pulse of the encoder signal is assumed, and control calculation is executed at a period of about several kHz to 20 kHz. For such inputs having an asynchronous relationship, the synthesizing unit 26 adds them while adjusting the timings. The synthesizing unit 26 outputs a PWM signal based on the addition result of the operation quantities to the carriage motor driver 640. The carriage motor driver 640 rotates the carriage motor 5, and the carriage 3 moves through the timing belt 7.

To implement high-speed calculation derived from a change in pulse of the encoder signal, it is assumed that control calculation by the sliding mode control calculation unit 39 is executed by hardware such as an ASIC.

Referring to FIG. 5, a range surrounded by a two-dot dashed line is implemented in the ASIC 603. As is apparent from FIG. 5, the ASIC 603 is responsible for the functions of the sliding mode control calculation unit 39, the control quantity estimation unit 23, the calculation timing generation unit 50, the state quantity estimation unit 25, and the synthesizing unit 26. To the contrary, in FIG. 5, a range surrounded by a thick dotted line is implemented by executing a program in the MPU 601. As is apparent from FIG. 5, the MPU 601 is responsible for the functions of the PID control calculation unit 36, the target value calculation unit 35, and the preprocessing calculation unit 38.

The reason why the MPU 601 and the ASIC 603 share the feedback control is that the update period of the information processed in the portion implemented by the ASIC (hardware) 603 is shorter than that of the information processed in the portion implemented by the MPU 601.

The calculation by the preprocessing calculation unit 38 is also executed every time the target value calculation unit 35 updates the target value, and the latest register setting value is set in the register area of the ASIC 603. The preprocessing calculation unit 38 performs calculation for managing, as parameter values, only during the calculation period of the PID control calculation unit 36, some of variable values that change moment by moment in calculation of the phase switchover line executed by the sliding mode control calculation unit 39 or estimation calculation of the state quantity estimation unit 25. Execution of all the feedback control by the ASIC leads to upsizing of the integrated circuit, and flexibility and versatility of processing lack. Thus, in this embodiment, the calculation accuracy and the circuit scale are compromised, and the preprocessing calculation unit 38 of the MPU executes part of calculation at the update timing.

A control parameter to be used by the sliding mode control calculation unit 39 may be changed in accordance with the operation state of the carriage 3. In this case, based on the target value of the target value calculation unit 35, a section of one of an acceleration state, a constant velocity state, and a deceleration state, in which the carriage 3 is located is determined. By changing, for each section, the switchover coefficient to be used to calculate the phase switchover line, an appropriate switchover line according to a carriage operation condition may be selected to implement rapid convergence.

4. Explanation of Timing Signal Generated by Calculation Timing Generation Unit 50

Figure 7A:
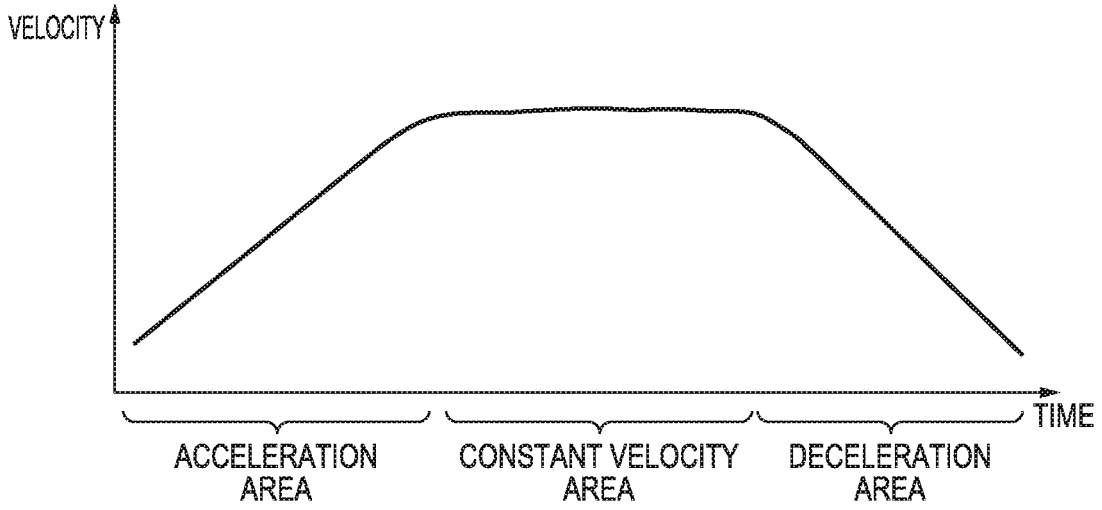
FIGS. 7A and 7B are graphs each showing the velocity profile of a carriage of the printing apparatus shown in FIG. 3.
Figure 7B:
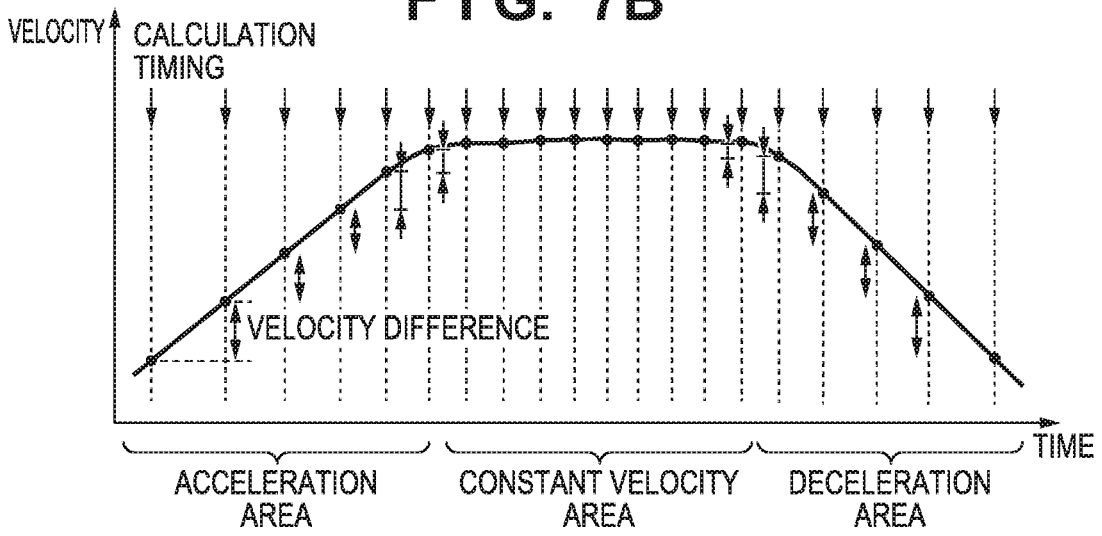

FIGS. 7A and 7B are graphs each showing the velocity profile of the carriage of the printing apparatus shown in FIG. 3.

FIG. 7A shows an example of the velocity profile of the carriage 3 driven by the carriage driving mechanism of the printing apparatus 1. This velocity profile is divided into three areas of an acceleration area, a constant velocity area, and a deceleration area, and it is assumed that the velocity is highest in the constant velocity area. In order to implement this velocity profile, the first feedback loop including the first control unit 22 shown in FIG. 1A performs main control.

In FIG. 7B, each calculation timing calculated in the second feedback loop including the second control unit 24 is indicated by a downward thick arrow on the velocity profile. In the acceleration area and the deceleration area, the velocity difference required for generating the calculation timing can be obtained with a certain magnitude, and this magnitude is indicated by the vertical double-headed arrow. On the other hand, the velocity difference becomes small in the constant velocity area, and this is indicated by a small arrow or the absence of the arrow.

Figure 8:
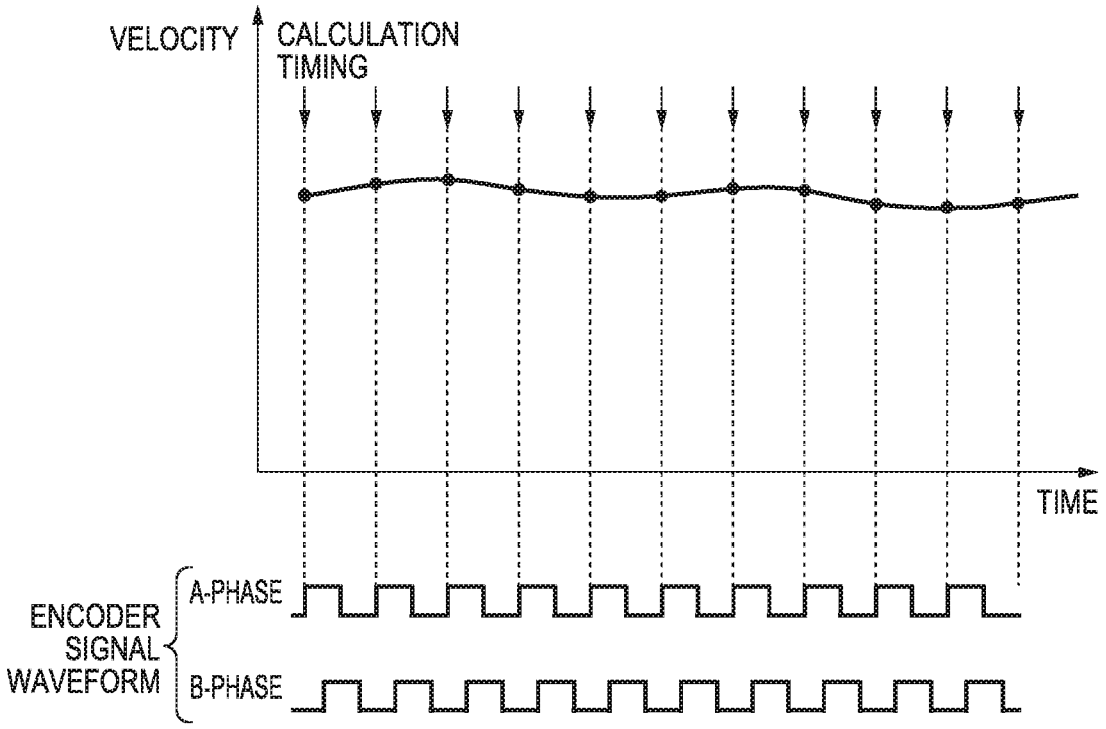
FIG. 8 is an enlarged view showing a case in which each calculation timing calculated in the second feedback loop in a constant velocity area shown in FIG. 7B is set at the A-phase leading edge of the encoder signal.

FIG. 8 is an enlarged view showing a case in which each calculation timing calculated in the second feedback loop in the constant velocity area shown in FIG. 7B is set at the A-phase leading edge (rising edge) of the encoder signal, and the calculation timing is indicated by a downward thick arrow.

The time area shown in FIG. 8 is the constant velocity area which is a part of the entire velocity profile shown in each of FIGS. 7A and 7B. However, as shown in FIG. 8, even in the constant velocity area, a micro-velocity vibration occurs due to the influence of motor cogging or the like. If the state quantity estimation unit 25 measures the pulse width of the input encoder signal to calculate the velocity while such micro-velocity vibration exists, it is greatly affected by the quantization error.

Figure 9:
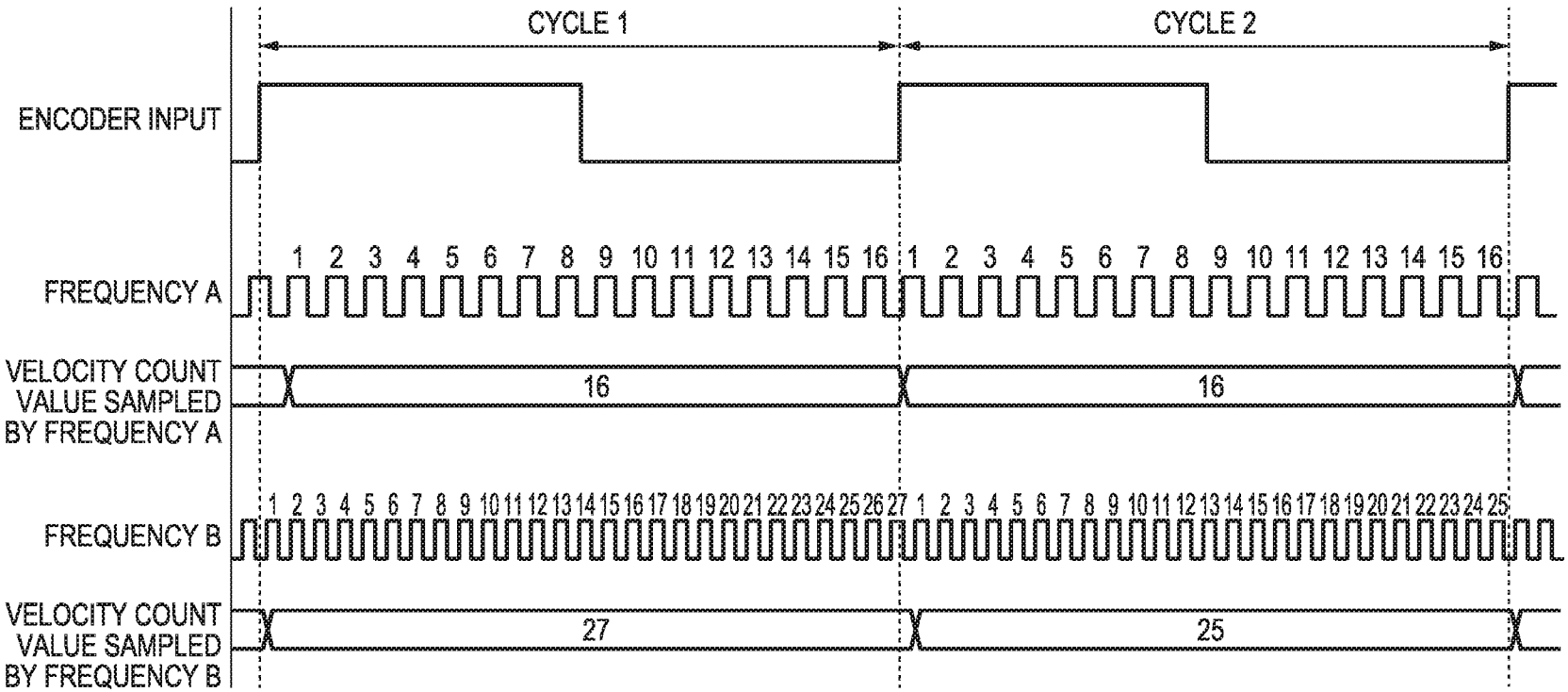
FIG. 9 is a timing chart for explaining a quantization error in a case in which velocity information is acquired at a timing of the leading edge of an encoder input.

FIG. 9 is a timing chart for explaining the quantization error in a case in which the velocity information is acquired at a timing of the leading edge (rising edge) of an encoder input.

As shown in FIG. 9, when the encoder input is sampled at a frequency A at a given timing, the velocity count values of cycle 1 and cycle 2 become the same ("16"). On the other hand, when the encoder input is sampled at a frequency B, the velocity count values are "27" and "25" in cycle 1 and cycle 2, respectively, so that there is a difference between the velocity count values. Such rounding of the count value is called a quantization error.

The higher the sampling frequency, the higher the resolution of the counter, and the less the influence of the quantization error, so that the more accurate counting result can be obtained. However, the higher frequency of the device leads to disadvantages such as increased power consumption. Therefore, it is realistic to design the device to operate at an appropriate frequency in recognition that the quantization error is included to some extent.

In the velocity profile shown in each of FIGS. 7A and 7B, the ratio of the quantization error in the velocity counting increases in the constant velocity area where the velocity difference becomes small, as compared with the velocity counting in the acceleration area or the deceleration area where the velocity difference is large. Further, it is conceivable that the calculation result of the sliding mode control calculation unit 39 that is processing to suppress vibration will be adversely affected. Therefore, in order to reduce the influence of the quantization error, the calculation timing generation unit 50 inserts processing of thinning out the calculation timing when the velocity of the control target has reached a predetermined velocity or when the moving position of the control target has reached a predetermined position. With this processing, the calculation interval is changed based on the velocity profile shown in each of FIGS. 7A and 7B, so that the influence of the quantization error can be reduced.

Figure 10:
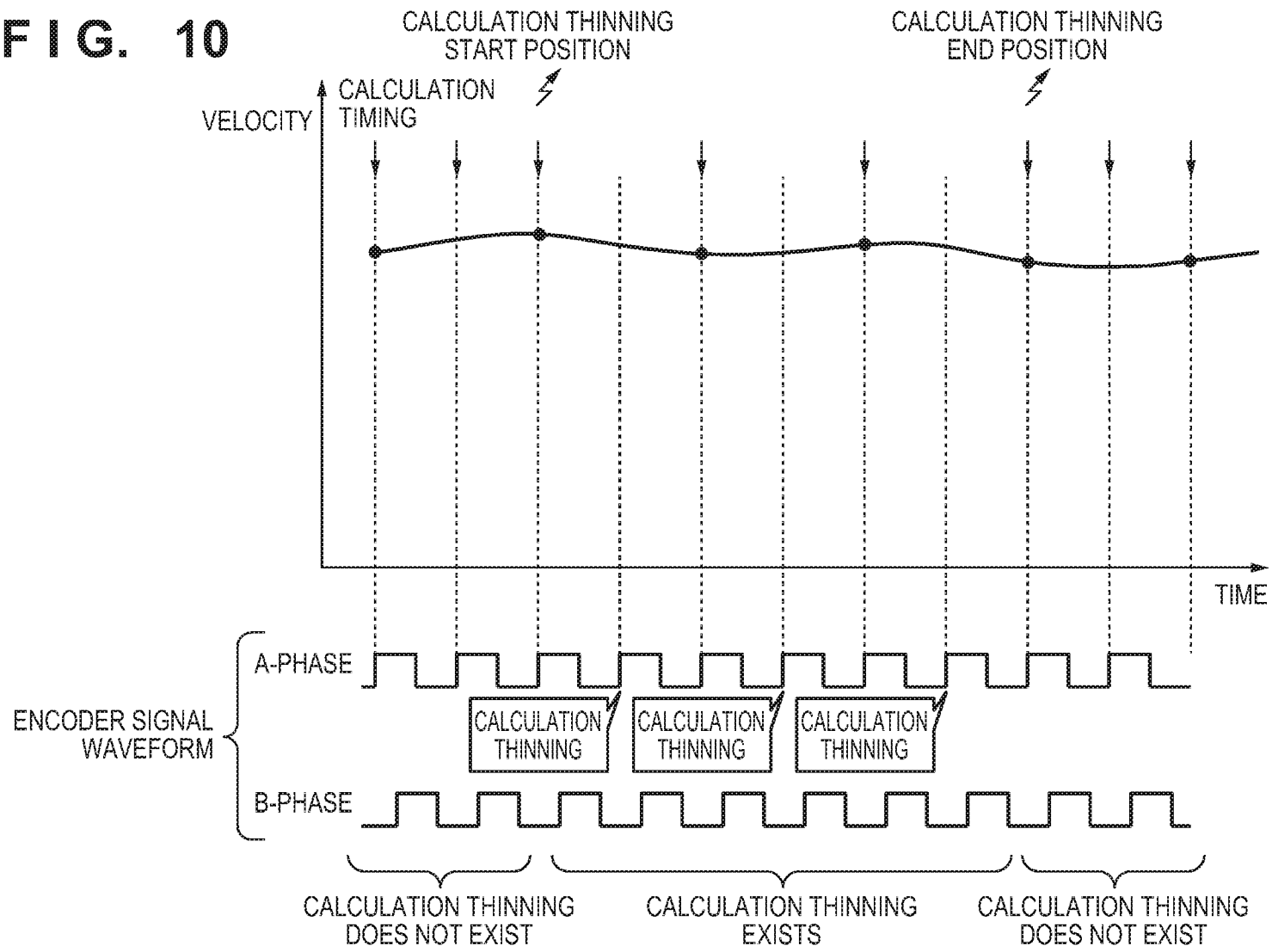
FIG. 10 is a view showing the calculation timings in a case in which each calculation timing is set at the A-phase leading edge of the encoder signal as shown in FIG. 8, but some calculation timings are thinned out.

FIG. 10 is a view showing the calculation timings in a case in which each calculation timing is set at the A-phase leading edge of the encoder signal as shown in FIG. 8, but some calculation timings are thinned out.

According to FIG. 10, when the control quantity estimation unit 23 detects that the control target has reached a predetermined position, the calculation timing generation unit 50 generates a calculation timing signal, and the calculation result is reflected on the control target. However, when the next A-phase leading edge of the encoder signal is detected, the calculation timing generation unit 50 thins out the generation operation of the calculation timing signal and outputs no calculation timing signal to the state quantity estimation unit 25, so the calculation processing of the second feedback loop is not performed. When the further next A-phase leading edge of the encoder signal is detected, the calculation timing generation unit 50 generates the calculation timing signal, so that the calculation processing of the second feedback loop is performed.

Such control is repeated until the control target reaches the calculation thinning end position. More specifically, this control is performed until the movement of the carriage 3 shifts from the constant velocity area to the deceleration area. Here, the state quantity estimation unit 25 holds the sum of the velocity/acceleration information obtained at the A-phase leading edge detection timing immediately before the preceding detection timing and the current velocity/acceleration information. Therefore, the sliding mode control calculation unit 39 executes calculation corresponding to it.

Note that the example shown in FIG. 10 describes an example in which the thinning processing is performed when the control target has reached a predetermined position, but the similar thinning processing may be performed when the control target has reached a predetermined velocity.

As described above, the calculation timing thinning processing is performed when the velocity of the control target has reached the maximum velocity and enters the constant velocity area on the velocity profile. At this time, in consideration of the influence of the quantization error, the timing of performing the calculation processing of the second feedback loop is desirably acquired from one phase and one edge (for example, the A-phase and the leading edge) of the information obtained from the encoder sensor. In this case, when the calculation timing thinning processing is performed, the influence of the quantization error can be reduced, but the update cycle of the velocity/acceleration information is increased. This leads to a disadvantage that the feedback control traceability deteriorates. To solve this problem, in this embodiment, the calculation timing generation unit 50 uses the information of the encoder signals of both phases, and generates the calculation timing signal such that the update cycle of the velocity/acceleration information is not increased and the feedback control traceability does not deteriorate even if the thinning processing is performed.

Figure 11:
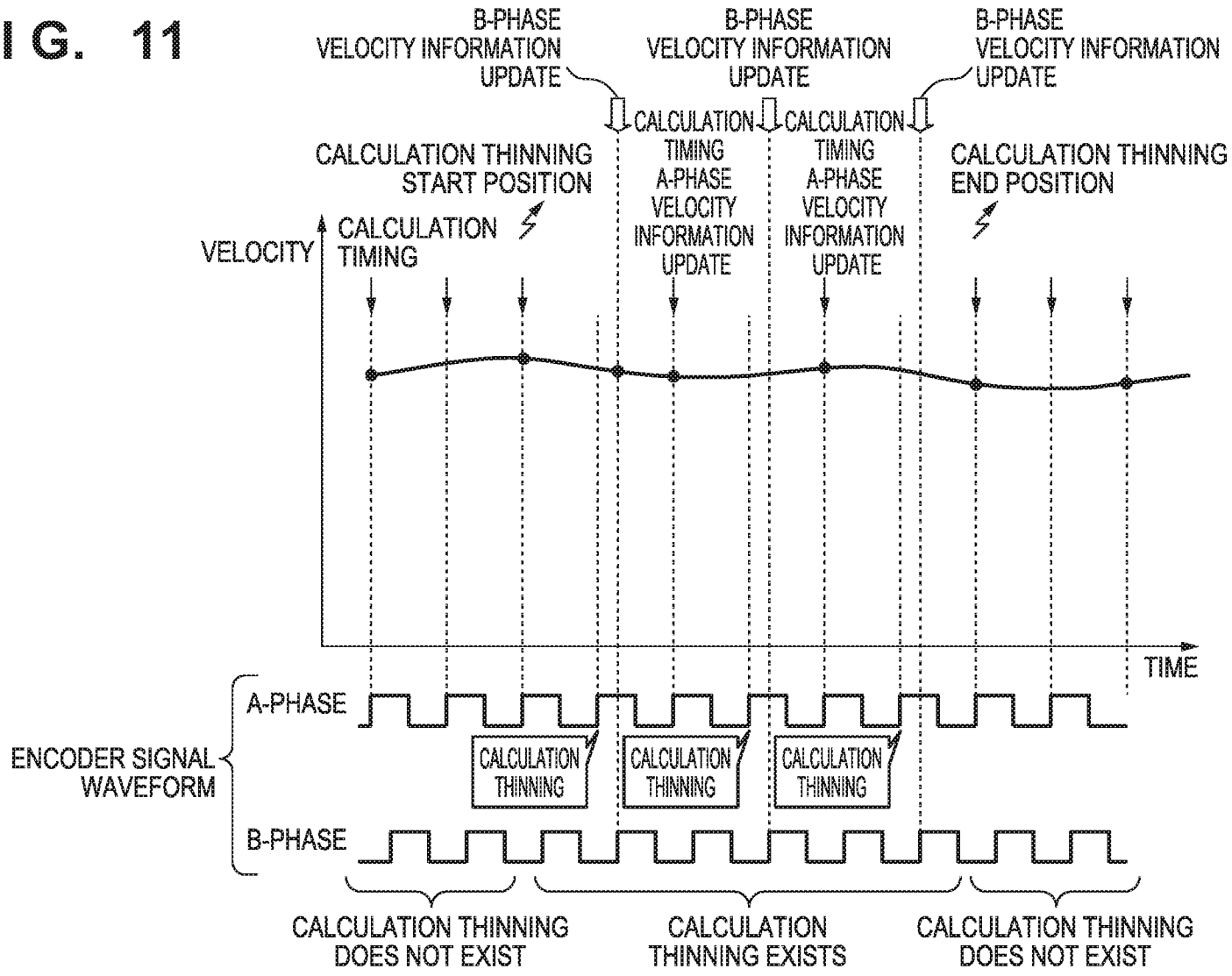
FIG. 11 is a view showing a case in which each calculation timing is set at the A-phase leading edge as shown in FIG. 8, but some calculation timings are thinned out and each velocity information update timing is further set at the B-phase leading edge.

FIG. 11 is a view showing a case in which each calculation timing is set at the A-phase leading edge (rising edge) as shown in FIG. 8, but some calculation timings are thinned out and each velocity information update timing is further set at the B-phase leading edge.

According to FIG. 11, when the control quantity estimation unit 23 detects that the control target has reached a predetermined position, the calculation timing generation unit 50 generates a calculation timing signal, and the calculation result is reflected on the control target. However, when the next A-phase leading edge of the encoder signal is detected, the calculation timing generation unit 50 thins out the generation operation of the calculation timing signal and outputs no calculation timing signal to the state quantity estimation unit 25, so the calculation processing of the second feedback loop is not performed.

However, as shown in FIG. 11, when the B-phase leading edge immediately after the A-phase leading edge at which the thinning is performed is detected, the calculation timing generation unit 50 acquires the velocity information based on the B-phase encoder signal and inputs this velocity information to the state quantity estimation unit 25. Therefore, when the next A-phase leading edge is detected, the calculation timing generation unit 50 generates and outputs a calculation timing signal, and when the calculation processing of the second feedback loop is performed, the updated velocity information based on the B-phase encoder signal is also reflected.

Therefore, according to the embodiment described above, by applying the feedback control arrangement formed from the first and second control units to the carriage driving control of the printing apparatus, it becomes possible to suppress the velocity vibration which cannot be suppressed conventionally. In addition, in the parameter setting of the first control unit, the area for coping with the variation factor of the control target can be reduced, so that deterioration of the feedback control traceability can be minimized. Thus, according to this embodiment, compatibility between vibration suppression and traceability of the carriage as the control target of the feedback control can be achieved, so that it is possible to perform carriage driving control more accurately, thereby implementing high-quality image printing.

In addition, according to the embodiment described above, the velocity information is acquired from the B-phase encoder signal, so that the velocity information of the carriage is updated while the generation operation of the calculation timing signal is thinned out based on the A-phase leading edge. Therefore, the velocity information update frequency is maintained even if the calculation processing is thinned out, so that it is possible to prevent deterioration of the feedback control traceability. Note that when both the A-phase and B-phase are used, the intervals of the update timings become unequal. Accordingly, this may be advantageous with respect to noise of a particular frequency.

Figure 12:
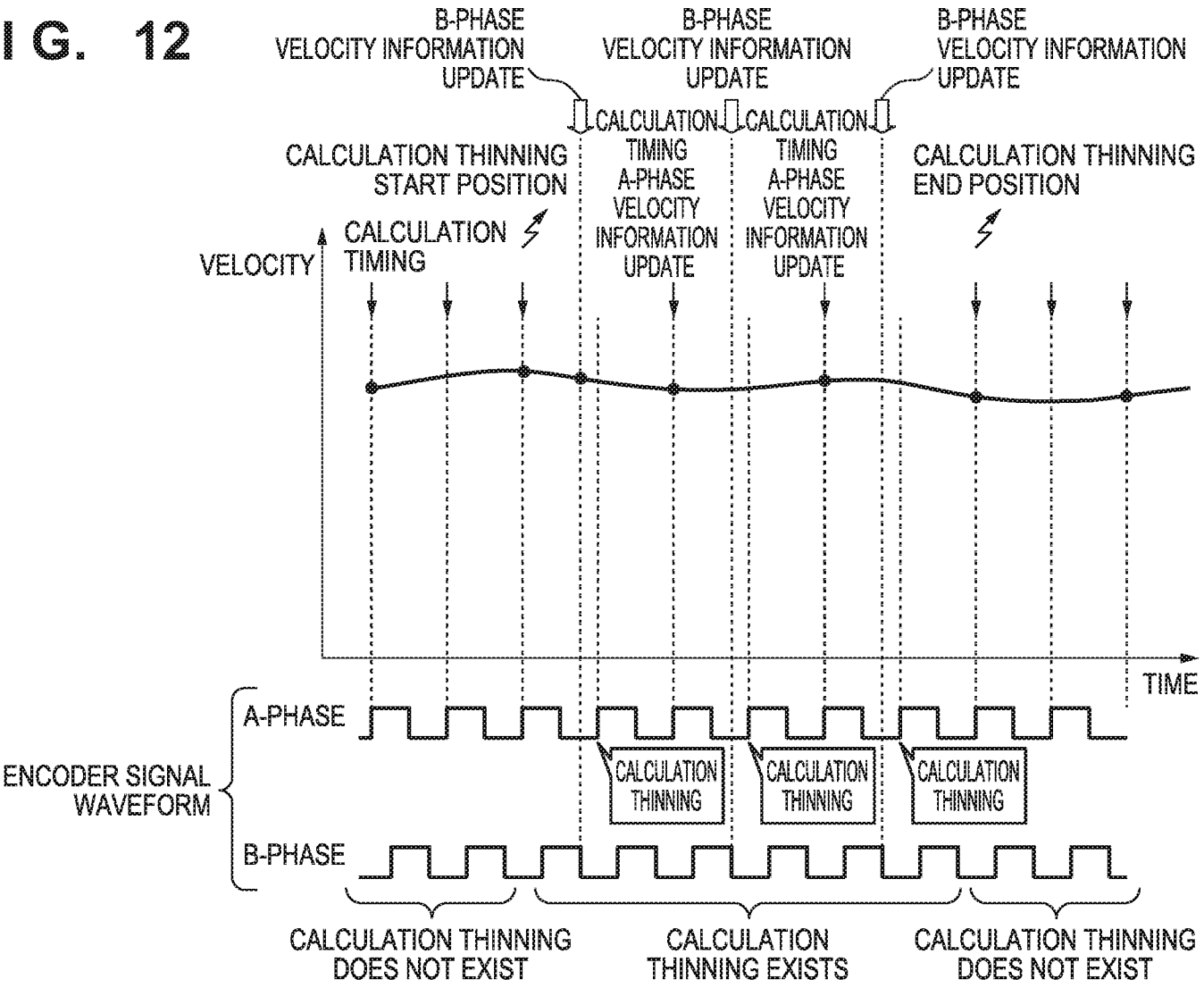
FIG. 12 is a view showing a case in which each calculation timing is set at the A-phase leading edge as shown in FIG. 8, but some calculation timings are thinned out and each velocity information update timing is further set at the B-phase trailing edge.

Note that FIG. 11 shows an example in which the velocity information is updated at a timing of detecting the B-phase leading edge, but deterioration of the feedback control traceability can be similarly prevented by updating the velocity information at the timing of detecting the B-phase trailing edge (falling edge) as shown in FIG. 12.

Regarding the timing of performing the calculation thinning, the present invention is not limited to the examples described above. For example, the calculation thinning may be performed over a plurality of detection timings of the encoder signal edges. In this case, the velocity information update timing based on the encoder signal of the phase, which is not used for the calculation timing thinning, may be arbitrarily set.

5. Explanation of Another Application Example of Feedback Control

The present invention is applicable to any control of moving an object by driving the motor, as described above. Therefore, the present invention is applicable to, for example, control of the scanner motor that moves the CCD sensor or the CIS of the scanner apparatus having a single function or the scanner unit of a multi-function printer (MFP).

To ensure the image reading performance, the scanner unit needs to acquire an image signal by matching the movement quantity of the scanner unit and the light source lighting timing of the CCD sensor or the CIS. Since the light source lighting timing generally assumes that the moving velocity of the scanner unit is constant, it is important to suppress the velocity vibration of the scanner unit. Therefore, since the vibration target to be suppressed is the moving velocity of the scanner unit, the combination of the state quantities of the velocity and the acceleration is applied to the above-described second control unit. Basically, control is performed with the same arrangement as the carriage control arrangement described with reference to FIG. 5.

This can suppress a micro-vibration at a high-frequency of the scanner unit, which cannot be suppressed by only the conventional control, and improve the feedback control traceability. As a result, high-quality image reading can be achieved.

The present invention is also applicable to conveyance roller driving control of the printing apparatus described with reference to FIGS. 5 and 6. The printing apparatus rotates the conveyance roller for each carriage scanning operation to intermittently convey the print medium. To suppress a conveyance quantity vibration at this time, feedback control according to the present invention can be applied. In this case, since the control target is the conveyance quantity (position vibration) of the print medium, the rotation quantity and rotational velocity of the conveyance roller are respectively input as the first and second state quantities to the above-described second control unit.

This can implement more accurate conveyance control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-169579, filed Sep. 18, 2019, which is hereby incorporated by reference herein in its entirety.

What is claimed is:

1. An electric apparatus for controlling movement of an object, comprising:

a detection unit configured to detect the movement of the object;

a first estimation unit configured to estimate, based on a detection signal output from the detection unit, a control quantity for performing first feedback control for the object in a first period;

a timing signal generation unit configured to generate, based on the detection signal output from the detection unit, a timing signal for estimating a state quantity of the object in order to perform second feedback control for the object in a second period shorter than the first period;

a second estimation unit configured to estimate the state quantity based on the timing signal generated by the timing signal generation unit;

a first generation unit configured to generate, based on the control quantity estimated by the first estimation unit, a first operation quantity for the first feedback control;

a second generation unit configured to generate, based on the state quantity estimated by the second estimation unit, a second operation quantity for the second feedback control; and a synthesizing unit configured to generate an operation quantity of the object from the first operation quantity and the second operation quantity.

2. The apparatus according to claim 1, wherein the state quantity comprises a first state quantity of the object and a second state quantity obtained by time differentiation of the first state quantity.

3. The apparatus according to claim 2, wherein the timing signal generation unit generates the timing signal at a timing of detecting a pulse edge of the detection signal.

4. The apparatus according to claim 2, wherein the timing signal generation unit thins out a generation operation of the timing signal if a moving velocity of the object has reached a predetermined velocity or if a moving position of the object has reached a predetermined position.

5. The apparatus according to claim 2, wherein the electric apparatus comprises a printing apparatus configured to print on a print medium with a printhead by reciprocally moving a carriage mounted with the printhead, and the object comprises the carriage.

6. The apparatus according to claim 5, wherein a range of the reciprocating movement of the carriage includes an acceleration area of the carriage, a constant velocity area of the carriage, and a deceleration area of the carriage, the first state quantity comprises a position of the carriage, and the second state quantity comprises a velocity of the carriage.

7. The apparatus according to claim 6, wherein the detection unit includes an encoder sensor configured to detect the position of the carriage, and the position of the carriage is estimated by counting a pulse signal of an encoder signal output from the encoder sensor, and the velocity of the carriage is estimated by measuring a pulse width of the pulse signal.

8. The apparatus according to claim 7, wherein the encoder signal includes a pulse of an A-phase encoder signal and a pulse of a B-phase encoder signal whose phases are different from each other by 90°, and in the constant velocity area of the carriage, the timing signal generation unit partially thins out the generation operation of the timing signal upon detecting a leading edge of the pulse of the A-phase encoder signal.

9. The apparatus according to claim 8, wherein upon detecting a leading edge of the pulse of the B-phase encoder signal immediately after the leading edge of the pulse of the A-phase encoder signal at which the generation operation of the timing signal is thinned out, the timing signal generation unit acquires velocity information of the carriage based on the detected leading edge of the pulse of the B-phase encoder signal, and outputs the acquired velocity information to the second estimation unit.

10. The apparatus according to claim 9, wherein the timing signal generation unit generates the timing signal upon detecting a next leading edge of the pulse of the A-phase encoder signal after the pulse of the A-phase encoder signal at which the generation operation of the timing signal is thinned out, and in order to input the generated timing signal and perform the second feedback control, the second estimation unit reflects the velocity information of the carriage acquired based on the detected leading edge of the pulse of the B-phase encoder signal on estimation of the position of the carriage and the velocity of the carriage.

11. The apparatus according to claim 1, wherein the electric apparatus comprises one of a scanner apparatus configured to read an image of an original by a scanner unit mounted with a CIS or a CCD sensor by moving the scanner unit, and a multi-function printer obtained by providing the scanner apparatus in a printing apparatus for printing on a print medium by a printhead by reciprocally moving a carriage mounted with the printhead, and the object comprises the scanner unit.

12. A control method for an electric apparatus for controlling movement of an object, comprising:

detecting the movement of the object;

estimating, based on a detection signal output in the detecting, a control quantity for performing first feedback control for the object in a first period;

generating, based on the detection signal output in the detecting, a timing signal for estimating a state quantity of the object in order to perform second feedback control for the object in a second period shorter than the first period;

estimating the state quantity based on the generated timing signal;

generating, based on the estimated control quantity, a first operation quantity for the first feedback control;

generating, based on the estimated state quantity, a second operation quantity for the second feedback control; and generating an operation quantity of the object from the first operation quantity and the second operation quantity.

13. The method according to claim 12, wherein the state quantity comprises a first state quantity of the object and a second state quantity obtained by time differentiation of the first state quantity.

14. The method according to claim 13, wherein in the generating the timing signal, the timing signal is generated at a timing of detecting a pulse edge of the detection signal.

15. The method according to claim 13, wherein in the generating the timing signal, the generation of the timing signal is thinned out if a moving velocity of the object has reached a predetermined velocity or if a moving position of the object has reached a predetermined position.

16. The method according to claim 13, wherein the electric apparatus comprises a printing apparatus configured to print on a print medium with a printhead by reciprocally moving a carriage mounted with the printhead, and the object comprises the carriage.

17. The method according to claim 16, wherein a range of the reciprocating movement of the carriage includes an acceleration area of the carriage, a constant velocity area of the carriage, and a deceleration area of the carriage, the first state quantity comprises a position of the carriage, and the second state quantity comprises a velocity of the carriage.

18. The method according to claim 17, wherein in the detecting, the position of the carriage is detected by an encoder sensor, and the position of the carriage is estimated by counting a pulse signal of an encoder signal output from the encoder sensor, and the velocity of the carriage is estimated by measuring a pulse width of the pulse signal.

19. The method according to claim 18, wherein the encoder signal includes a pulse of an A-phase encoder signal and a pulse of a B-phase encoder signal whose phases are different from each other by 90°, and in the generation of the timing signal, in the constant velocity area of the carriage, the generation of the timing signal is partially thinned out upon detecting a leading edge of the pulse of the A-phase encoder signal.

20. The method according to claim 12, wherein the electric apparatus comprises one of a scanner apparatus configured to read an image of an original by a scanner unit mounted with a CIS or a CCD sensor by moving the scanner unit, and a multi-function printer obtained by providing the scanner apparatus in a printing apparatus for printing on a print medium by a printhead by reciprocally moving a carriage mounted with the printhead, and the object comprises the scanner unit.

* * * * *